United States Patent [19]

Landa

[11] 4,278,884

[45] Jul. 14, 1981

[54] METHOD AND APPARATUS FOR XERORADIOGRAPHY

[75] Inventor: Benzion Landa, Edmonton, Canada

[73] Assignee: Savin Corporation, Valhalla, N.Y.

[21] Appl. No.: 958,978

[22] Filed: Nov. 9, 1978

[51] Int. Cl.[3] ..... G03G 15/08

[52] U.S. Cl. ..... 250/315.2; 118/647

[58] Field of Search ..... 250/315 A; 118/647

[56] References Cited

U.S. PATENT DOCUMENTS 4,038,943 8/1977 Nelson et al. ..... 250/315 A

*Primary Examiner*—Alfred E. Smith
*Assistant Examiner*—T. N. Grigsby
*Attorney, Agent, or Firm*—Shenier & O'Connor

[57] ABSTRACT

My invention comprises a novel method of increasing the effective sensitivity of photoconductors to discharge by ionizing radiations by masking a latent electrostatic image formed by exposure of a subject to ionizing radiations, masking the latent electrostatic image, and then subjecting the masked electrostatic image to light exposure to increase the contrast of the latent electrostatic image. The thus enhanced latent electrostatic image is then developed by either positive or negative development, and the developed image may, if desired, be transferred to a carrier sheet. The invention reduces the Roentgen level to which a patient is exposed. One form of apparatus for carrying out this method is shown, comprising a first toning means for masking the latent electrostatic image and means for subjecting the masked electrostatic image to enhancement by flooding the same with light exposure. A second toning means for developing the enhanced electrostatic image is provided.

2 Claims, 7 Drawing Figures

DEVELOP

CHARGE

EXPOSE

DEVELOP

TRANSFER

METHOD AND APPARATUS FOR XERORADIOGRAPHY

CROSS-REFERENCE TO RELATED APPLICATION

In my copending application, Ser. No. 908,355, filed May 22, 1978, I have disclosed an improved method of electrophotography and apparatus for practicing the same, which enables me to increase the effective speed of a photoconductor in response to exposure by visible light. In the instant application, I disclose a related method and apparatus for increasing the speed of effective response of charged photoconductors to discharge by ionizing radiations.

BACKGROUND OF THE INVENTION

It is well known that the surface charge on a photoconductor can be dissipated by ionizing radiations—as, for example, radiation by X-rays. Since a latent electrostatic image on a photoconductor can be rapidly developed, it could be of considerable importance during surgical procedures. Unfortunately, the length of exposure time necessary for obtaining a xeroradiograph is too long, so that its use has been centered chiefly on mammography. Since exposure to ionizing radiations can have deleterious effects, efforts have been made to decrease exposure time in all applications, including the use of silver halide film. In xeroradiography, the phenomenon of edge enhancement improves mammographic image detail over conventional film imaging, owing to the fact that it emphasizes the border characteristics of masses.

In the exposure of, say, a fractured tibia, using a rapid medical silver halide film, an exposure of ten mas (milliampere seconds) with a voltage of fifty-eight kvp (kilovolts, peak) would be used. Efforts are constantly being made to enable the use of xeroradiography with the application of a reduction in the time of exposure of a patient to ionizing radiations for a given required kvp.

FIELD OF THE INVENTION

My invention relates to a novel method of increasing the effective sensitivity of photoconductors to discharge by ionizing radiations, thus enabling me to reduce the time of exposure of a patient to ionizing radiations such as X-rays, radioactive isotopes, and the like, and thereby reduce the quantum of Roentgens to which the patient is exposed.

DESCRIPTION OF THE PRIOR ART

Schaffert et al U.S. Pat. No. 2,666,144 discloses that photoconductors may be discharged in response to X-rays and the exposed photoconductor developed by a dry toner. The exposure time disclosed in this patent is sixty seconds, which is totally unacceptable for medical use owing to the damage which would be done to a patient.

Phillips U.S. Pat. No. 2,859,350 attempts to increase the speed of a response to a photoconductor in xeroradiography by using an intensifying screen of a high molecular weight metal. There is no suggestion that the process could be used in connection with medical X-rays.

Metcalfe et al U.S. Pat. No. 3,210,543 discloses the provision of a conversion screen which emits rays in a region corresponding to the absorption bands of the photoconductor in response to X-rays. While this may reduce the exposure time for making xeroradiographs, there is no suggestion that the time of exposure has been sufficiently shortened to enable xeroradiography to be applied to medical use with safety.

SUMMARY OF THE INVENTION

In general, my invention contemplates electrostatically charging a photoconductive plate and then enclosing it in a light-proof cassette, after which it is subjected to a pattern of absorption and passage of the ionizing radiations to form an electrostatic image. The exposure time, however, is much less than that required to produce a satisfactory radiograph. The photoconductive plate bearing the weak latent electrostatic image is then masked in the dark to shield the faint latent electrostatic image while leaving only the areas which have been most highly discharged unmasked. The plate with the latent image thus differentially shielded from light is then subjected to light to wholly or partially discharge the potential of the image by illumination as a function of the density of the optical shield. This enhances the contrast over the faint image areas. The thus enhanced electrostatic image is then developed in any appropriate manner and the developed image may, if desired, then be transferred to a carrier sheet, as described in my copending application.

One object of my invention is to provide an improved method of xeroradiography which will reduce the exposure time to which a subject is exposed to ionizing radiations.

Another object of my invention is to increase the effective speed of photoconductors when subjected to ionizing radiations and reduce the quantum of Roentgens to which a subject is exposed.

Another object of my invention is to provide for a novel apparatus for carrying out my improved method of xeroradiography.

Other and further objects of my invention will appear from the following description.

DESCRIPTION OF THE PREFERRED EMBODIMENT

Figure 1:
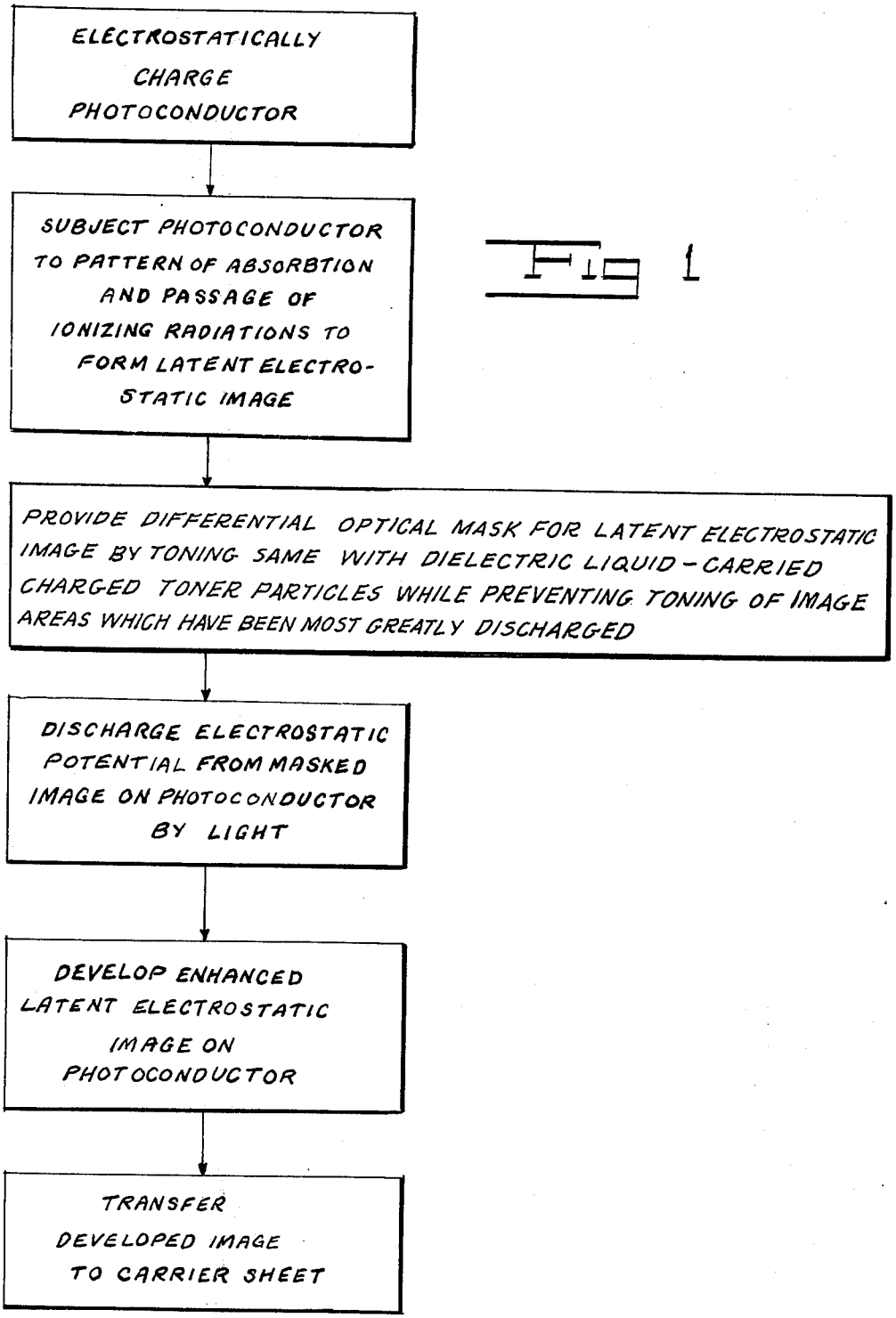
FIG. 1 is a flow diagram showing the steps of my improved method of xeroradiography, in which the full-line arrows indicate necessary steps and the broken-line arrows indicate optional steps of my process.
Figure 2:
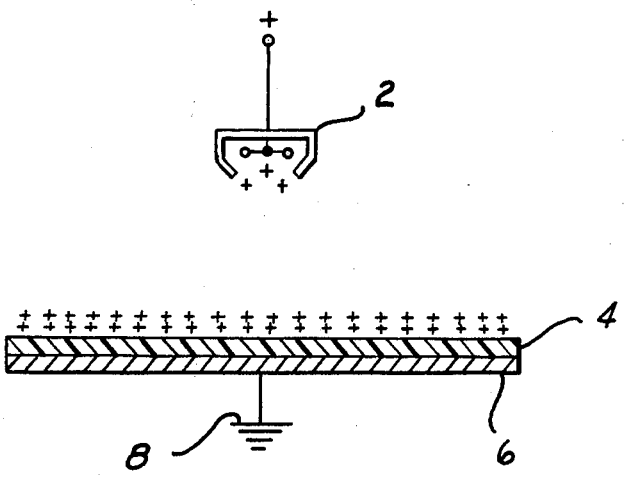
FIG. 2 is a diagrammatic view showing a charging station of an apparatus capable of carrying out my process.

More particularly, referring now to FIG. 2 of the drawings, a photoconductor, which may be a layer of amorphous selenium 4, is positioned upon a metal base 6 which is grounded at 8. The xerographic plate, comprising the photoconductor 4 and the metal base 6, is positively charged in a dark enclosure by a corona discharge assembly 2. It is to be understood that, if a photoconductor which takes an electron charge is used, the corona potential will be negative. After the photoconductive surface is charged, the assembly is positioned in a light-proof cassette (not shown), as is known in the art. The photoconductive selenium layer, or other photoconductor which may be used, provides a radiation-sensitive member. At low kvp (kilovolts, peak), a selenium xerographic plate has a speed equivalent to a Type A X-ray film. Low kvp radiations, however, are deleterious for medical use, since they are more readily absorbed by the tissues of the body. At higher energies, a selenium xeroradiographic plate is slower. The light-proof cassette is usually made of light aluminum and shuts out room light, but does not obstruct the passage of X-rays.

Figure 3:
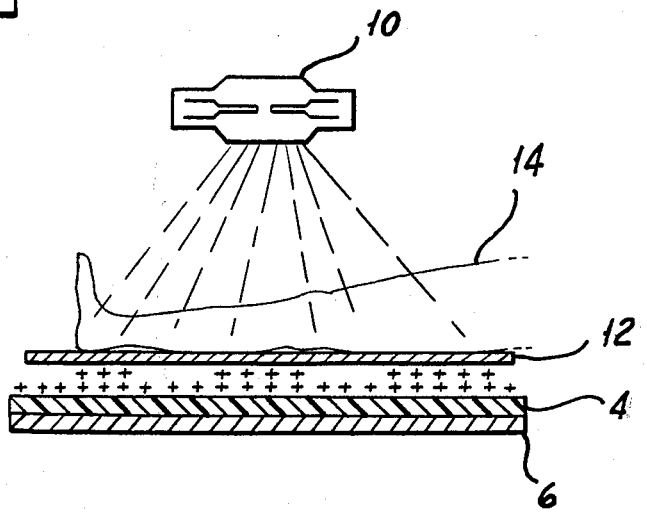
FIG. 3 is a diagrammatic view of a station showing apparatus capable of carrying out the step of exposing a subject to ionizing radiations, in which the light-proof cassette for the charged photoconductor is not shown.

The charged plate enclosed in the cassette (not shown) is then ready to be moved to the exposure station shown in FIG. 3. An X-ray tube 10 subjects the limb 14 of a patient which is in position upon a support plate 12, which may, if desired, be a filter of aluminum or made of Plexiglas (acrylic resin), to X-rays emanating from the tube 10. If the normal exposure is ten mas at fifty-eight kvp for a high-speed film using an intensifying screen, I am able to use a reduced exposure, which will of course produce an underexposed latent electrostatic image. The bones and dense portions of the limb of a patient being examined will absorb some of the ionizing radiations, while the flesh and less dense portions of the limb will permit the passage of the radiations, thus discharging the charged photoconductive plate as a function of the passage and absorption of the ionizing radiations, and creating a latent electrostatic image containing a pattern of light and shade corresponding thereto.

Heretofore, selenium plates could be used for exposures of limbs, hips, shoulders, cervical spine and ribs. They were, however, not fast enough for heavier parts of the body, such as the abdomen, pelvis and lumbar spine, according to the report of D. B. Slauson in *I.R.E. Transactions on Medical Electronics,* PGME-8, 4 (1957). By my invention, the reduction of exposure time—that is, reduction of the mas for a given kvp—enables xeroradiography to be employed more generally and more safely for medical applications. Selenium photoconductive plates may be reused in excess of six hundred times, and X-rays do not have any deteriorating effect on the selenium layer. If a voltage above one hundred kvp is used, a temporary fatigue effect becomes manifest. This effect can be eliminated by raising the temperature of the plate to about 120° F. before it is recharged.

The salient feature of my invention is obtaining a fully-developed radiograph though underexposing the subject to ionizing radiations. Since recent studies have shown that exposure to such radiations may have long-term deleterious effects, the enormous benefit of my invention will be manifest to those skilled in the radiographic art.

Figure 4:
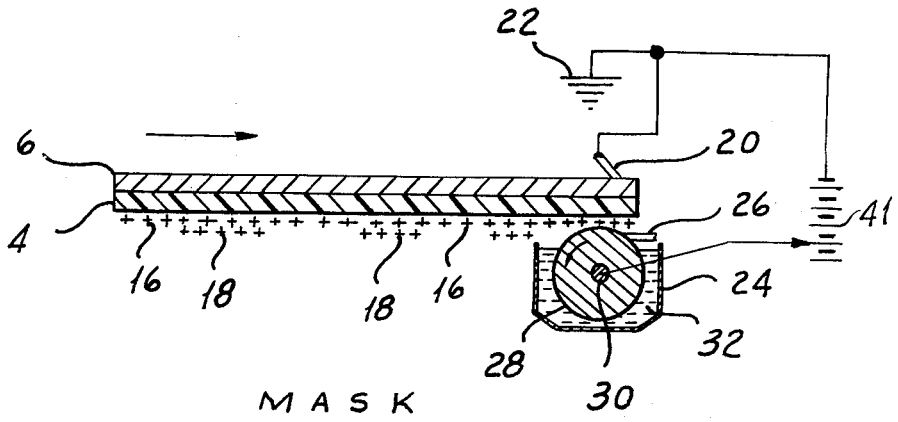
FIG. 4 is a diagrammatic view of a station showing one form of apparatus capable of carrying out the masking step of my process.

After exposure, the plate is removed in a dark enclosure from its light-proof cassette and subjected to a masking operation, one form of which is shown in FIG. 4. The image areas which have been most discharged by ionizing radiations are indicated by the reference numeral 16, and the other image areas are indicated by the reference numeral 18. The base plate 6 is grounded at 22 by a brush 20 in contact therewith, and the plate is moved in the direction of the arrow shown in the figure by any appropriate means (not shown). A toner applicator 28 is rotated by drive means (not shown) in the direction of the arrow. It is positioned in a toner tank 24 holding a toner 32 and rotates about an axle 30 which is biased above ground by an adjustable d.c. source 41. A doctor blade 26 serves to maintain a film of developer liquid on the applicator 28, but prevents the liquid from being thrown against the photoconductor 4 by centrifugal force. The toner applicator 28 is biased to a potential above that of the areas of the photoconductive plate which have been most greatly discharged. This prevents these areas from being toned, since toner will remain on the applicator instead of going to them. The areas other than those most greatly discharged will be toned as a function of the charge on the photoconductor. The tone will act as an optical mask or shield over the latent electrostatic image. The more lightly toned areas will be translucent and transmit some light as a function of toner deposit. It will be understood that the heavily toned areas of the image will transmit less light than those more lightly toned. The proper bias may easily be determined for a given Roentgen level empirically. It is to be understood that any appropriate mode of masking the underexposed photoconductor may be employed. Powder-cloud development, described in Section 8.1.4 of *Electrophotography,* by R. M. Schaffert (1975 Edition, The Focal Press, London and New York), may be employed since it produces a pronounced contrast graduation. The powder is deposited on the underexposed image in sufficient differential densities to shield the image areas from complete discharge by illumination in the enhancing step of my process.

Figure 5:
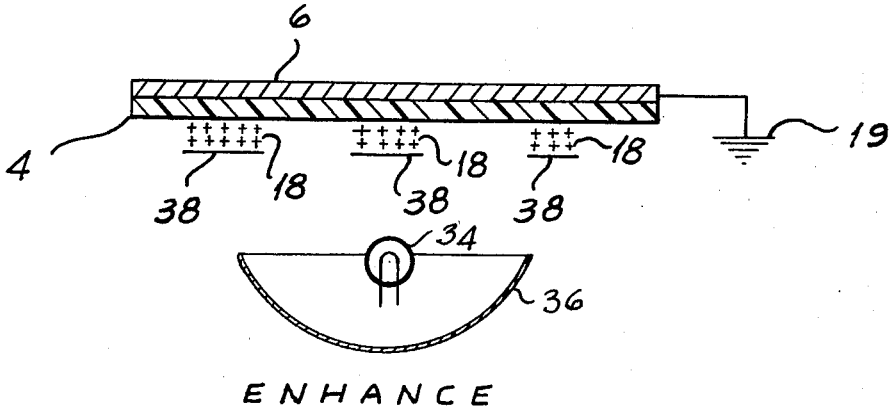
FIG. 5 is a diagrammatic view of a station showing one form of apparatus adapted to carry out the contrast enhancement step of my process.

The photoconductor bearing the masked weak latent electrostatic image is then passed to the enhancing station shown in FIG. 5. The image areas 18 are masked by toner layers 38 applied in the masking station shown in FIG. 4. The photoconductor is subjected to illumination by blanket light from any appropriate source such as lamp 34 positioned within a reflector 36. The base plate 6 is grounded at 19. The light makes the masked areas of the photoconductor differentially conductive, and a large portion of the non-image charge 16 shown in FIG. 4 is now conducted to ground, thus enhancing the contrast of the image. The shield may, if desired, be removed from the enhanced latent image by brushing, if a powder, or by wiping if a liquid developer is used.

Figure 6:
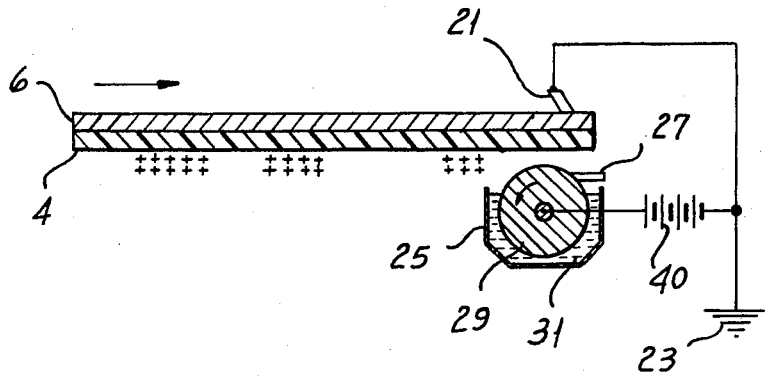
FIG. 6 is a diagrammatic view of a station showing one form of apparatus adapted to carry out the development step of my process.

The enhanced latent electrostatic image is then moved to a developing station, one form of which is shown in FIG. 6, while the photoconductor is still in a dark enclosure (not shown). In the form shown in FIG. 6, the photoconductor 4 and its associated backing member 6 are then moved in the direction of the arrow past a developer liquid positioned in tank 25, and the toner applicator roller 29 applies developer to the enhanced image. A doctor blade 27 prevents an excess of toner from being applied to the enhanced latent electrostatic image. In most cases, the image enhancing step shown in FIG. 5 will not discharge the unmasked areas of the image completely. With a liquid developer, in order to prevent the unmasked areas from being toned, a direct current potential from a battery 40 serves to bias the toner applicator 29, which is conductive, so that toner will not pass to the unmasked areas on which residual potential may reside. The potential from battery 40 is grounded to 23, as is the backing plate 6, through brush 21. The development of the enhanced image may be by the powder-cloud method, above referred to, or by any other appropriate method.

Viewers of medical radiographs are accustomed to reading them comfortably as negatives—that is, with the more dense structures as light areas and the fleshy portions of the body as dark areas. This is advantageous, since one can detect small changes in image density more readily as the average image brightness is reduced. In the case of a negative radiograph, this brightness is much lower than with a positive reproduction, since otherwise there would be large white areas present.

Xeroradiographs can be produced either as direct or reversal images merely by the selection of liquid developers of the required polarity. In the case of a latent image on a selenium photoconductor in which the image is positively charged, negatively charged toner particles in the developer liquid are required. If, however, a developer having positively charged toner particles dispersed in a liquid is used, the positively charged particles will be repelled by the image areas. If powder-cloud development is used, the powder may be white to produce the equivalent of a negative image on the dark selenium photoconductor.

When a liquid developer is used in the image enhancing step, there usually is a residual potential on the photoconductor. In such case, the bias on the toner applicator 29, shown in FIG. 6, must be adjusted so that it is above that of the unmasked areas and below that of the masked image areas. This prevents the unmasked areas from being toned.

It is observed that developer deposition begins in those portions of the electrostatic image characterized by high divergence of the electric field. This occurs at image edges and at lines and edges representing an abrupt change in contour. The edges or boundaries between areas of a charged and exposed photoconductive plate are of different potential levels as a function of the information present in the X-ray beam reaching the photoconductive surface. Fringe fields are strongest at these boundaries and weakest in areas of uniform charge. The fringe field directs more toner to the high-charge side of the step edge and less to the low-charge side. This edge development should take place without a development electrode in order to increase the edge effect. Edge development is widely used in obtaining mammographic image detail, since it emphasizes small contrast variations. My method makes mammographic xeroradiography much more useful, since very short exposures may be used in obtaining the desired detail of the extent and location of breast anomalies, owing to the masking and enhancing steps before the development step.

Figure 7:
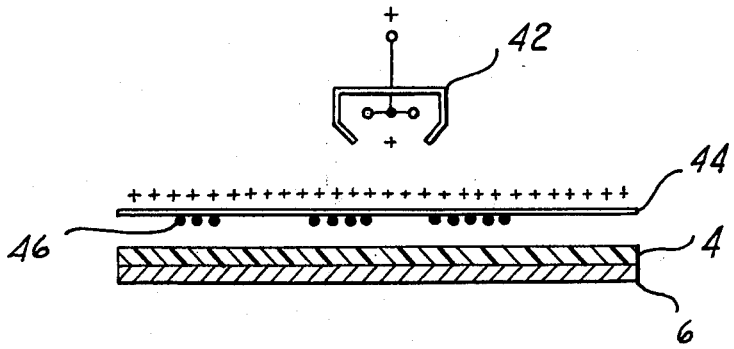
FIG. 7 is a diagrammatic view of a station showing apparatus adapted to carry out the transfer step of my process, if such be practiced.

After the image has been developed, it may be transferred to a carrier sheet such as paper 44, as shown in FIG. 7. The optional transfer step may be accomplished by charging the back of the carrier sheet 44 from a corona discharge assembly 42. If an adhesive toner is used, it may be transferred by pressure from a contacting roller (not shown). With corona transfer, the toner particles of the developed image carried by the photoconductor 4 will pass to the paper or carrier sheet 44. The back of the carrier sheet is charged with the proper potential to pull the developed image from the photoconductor. The polarity of course, will depend on whether a negative or positive image is being transferred.

While I have shown and described the development of an image on a photoconductive surface, it will be understood by those skilled in the art that, after I have enhanced the latent electrostatic image, I may wipe or brush the masking toner from the surface of the photoconductor and transfer the latent electrostatic image, thus enhanced, to a dielectric sheet on which it may then be toned or developed into a visible image. Such a sheet may, if desired, be a transparent dielectric sheet so that, with negative development, a radiologist may treat the radiograph in his accustomed manner and view it on the translucent illuminated background.

It will be seen that I have accomplished the objects of my invention. I have provided an improved method of xeroradiography which will greatly reduce the exposure time to which a subject is exposed to ionizing radiations. I have increased the effective speed of photoconductors when subjected to ionizing radiations, and have provided a novel apparatus for carrying out my improved method of xeroradiography. My method achieves the increase in speed with a reduction of the quantum of energy required and thus enables more xeroradiographs to be taken, in appropriate cases, without deleterious effects on a patient. Though I have described my method as being applicable chiefly to medical xeroradiography, it may also be employed advantageously in industrial xeroradiography.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In an apparatus for making xeroradiographs including in combination means for charging a photoconductor in the dark, exposing means for subjecting the charged photoconductor to a pattern of absorption and passage of ionizing radiations through a subject to form a latent electrostatic image of such absorption and passage, a first toning means for masking the latent electrostatic image, said toning means comprising a tank for holding a dielectric liquid carrying charged toner particles, an applicator roller for applying toner particles to said latent electrostatic image, biasing means for biasing said roller to a potential above that of the most greatly discharged areas of said latent image to prevent masking the same, means for illuminating the masked electrostatic image to enhance the same, means for developing the enhanced electrostatic image, and means for transferring the developed electrostatic image to a carrier sheet.

2. In a method of xeroradiography in which a photoconductor is charged in the dark in a charging step, subjected to a pattern produced by the absorption and passage of ionizing radiations through a subject to form a latent electrostatic image of such absorption and passage on the surface of a photoconductor in an exposing step, the latent electrostatic image is developed to provide a visible image on the photoconductor in a development step, the improvement comprising reducing the duration of the exposing step by a major portion of time required to form a latent electrostatic image of satisfactory contrast to present a latent electrostatic image having a first contrast, toning said first-contrast electrostatic image with dielectric liquid-carried charged toner particles, preventing the toning of the image areas which have been most greatly discharged to provide an optical mask for the first-contrast electrostatic image, flooding the masked first-contrast electrostatic image with light to reduce the charge on the unmasked areas of the photoconductor whereby to enhance the first-contrast electrostatic image to produce an electrostatic image having a contrast higher than said first contrast, and then transferring the developed image to a carrier sheet.

* * * * *